US005261465A

United States Patent [19]

Dore

[11] Patent Number: 5,261,465

[45] Date of Patent: Nov. 16, 1993

[54] SYSTEM FOR CONTROLLING THE UNWINDING OF THE WARP IN A LOOM WITH AT LEAST TWO WARP BEAMS

[75] Inventor: Dondi B. Dore, Marano Ticino, Italy

[73] Assignee: Ergotron S.A.S. di Dondi Benelli Dore & C., Novara, Italy

[21] Appl. No.: 901,017

[22] Filed: Jun. 19, 1992

[30] Foreign Application Priority Data

Jun. 19, 1991 [IT] Italy ..... 000464 A91

[51] Int. Cl.[5] ..... D03D 49/06

[52] U.S. Cl. ..... 139/103

[58] Field of Search ..... 139/110, 103, 97; 66/210, 211

[56] References Cited

U.S. PATENT DOCUMENTS 3,915,198 10/1975 Svaty .
4,546,801 10/1985 Bucher et al. .
4,572,244 2/1986 Kojima et al. ..... 139/103
4,662,407 5/1987 Duncan .
5,090,452 2/1992 Benelli ..... 139/110 X

FOREIGN PATENT DOCUMENTS 59-69360 4/1984 Japan .
2009260 6/1979 United Kingdom .

*Primary Examiner*—Andrew M. Falik
*Attorney, Agent, or Firm*—Sughrue, Mion, Zinn Macpeak & Seas

[57] ABSTRACT

The system for controlling the unwinding of the warp in a loom includes at least two warp beams and two electric motors for rotating the respective warp beams. Two sensor devices detect the tension of the warp threads which unwind from the two beams and are connected to two electronic regulation devices each associated with a respective motor for regulating the speeds of the motors so as to keep the tension of the warp substantially uniform. A switch is interposed between the sensors and the regulation devices for switching the connections between the sensors and the regulation devices at a predetermined frequency higher than the frequency at which the weft is beaten up in the loom.

2 Claims, 3 Drawing Sheets

SYSTEM FOR CONTROLLING THE UNWINDING OF THE WARP IN A LOOM WITH AT LEAST TWO WARP BEAMS

BACKGROUND OF THE INVENTION

The present invention relates to a system for controlling the unwinding of the warp in a loom in which the warp is wound onto at least two beams arranged end to end and rotatable independently of each other.

In weaving, in order to produce pieces of considerable width, for example, three meters wide or wider, looms are often used in which the warp or chain is wound not around a single beam but around twin beams. The preparation of a fairly long warp beam is actually quite problematical. It is, therefore, often preferred to use shorter, twin beams instead of a single beam of exceptional size. Thus, for example, twin beams each 1.5–3 meters long, the latter being a standard size, are currently used for weaving pieces 3–6 meters wide.

If twin warp beams are to be used, there is a problem in correctly controlling the unwinding of the warp in order to ensure the correct and even insertion of the weft threads.

This problem is complex and is not easy to solve if one takes account of the fact that two beams on which the same, nominally identical yarns are wound invariably have different characteristics which may adversely affect the weaving. Thus, even with the use of yarns which nominally have the same characteristics, because of different humidity and temperature conditions during the winding of the warp as well as the inevitably different torsional characteristics of the yarn, it is never certain that, when the two beams are rotated through the same angle, the same length of warp will unwind or that the warp tension will remain uniform.

Moreover, it must be remembered that the tension of the warp depends not only on the rate at which it unwinds from the beams, but also on the elasticity and any longitudinal non-elastic yielding of the yarns used. These characteristics, which are far from being rigorously uniform even in the best yarns, may even vary longitudinally of the same yarn because of its twist and sizing characteristics and may vary from thread to thread in yarn of the same type.

In view of the fact that the warp threads wound onto the twin beams never have exactly the same characteristics, the twin beams are typically mounted in the loom so as to be rotatable independently.

The interposition of a coaxial mechanical differential between the beams has been proposed, in order to compensate for the variations in the tensions of the rows of warp threads unwinding from each beam.

This solution has been found unsatisfactory both because, as a result of play and wear, the differential may bring about insufficiently precise corrections and because, in some situations, the fact that the differential has the characteristic of increasing the speed of one beam as the speed of the other decreases may lead to problems even more serious than those it was intended to solve.

Devices for regulating the unwinding of the warp have recently been adopted in looms with single warp beams, each device including an electric motor for rotating the beam in a controlled manner and a regulator which controls the speed of the electric motor in dependence on signals provided by an electrical sensor for detecting the tension of the warp threads. The signals provided by the sensor are processed to determine, in particular, the rate at which the beam must rotate in order to keep the tension of the warp as uniform as possible. The actual rate of rotation of the beam is detected, for example, by a tachometric dynamo connected to the motor which drives the beam and is compared with the speed calculated on the basis of the signals provided by the warp-tension sensor. The regulator then corrects the speed-of the-beam, bringing the actual speed of the beam to the value calculated on the basis of the warp tension detected.

Such a warp-tension regulator is constituted, for example, by the patented device produced and marketed by the Applicant under the trade name ¢TENDILENE".

With reference again to the problem of controlling the unwinding of the warp in a loom with twin beams, it has been proposed to provide the twin beams with respective devices of the type mentioned above for controlling the unwinding of the warp. This solution, in which the two devices for controlling the unwinding of the warp operate independently, represents very considerable progress compared with the solution based on the use of mechanical differential devices.

There are some situations, however, in which the use of two separate and independent devices for controlling the unwinding of the warp does not prevent the formation of defects in the fabric which may arise even as a result of extremely small variations in the lengths of the yarns unwound from the two beams according to their tension.

SUMMARY OF THE INVENTION

The object of the present invention is to provide a system for controlling the unwinding of the warp in a loom with twin beams which performs better than the known solution consisting of the use of two separate and independent devices for controlling the unwinding of the warp and which is adapted to allow the insertion of a single weft for both warps so that to an observer the weft inserted appears perfect and without the slightest defect of parallelism, particularly where the two warps meet, so as to form a fabric which is practically indistinguishable from one produced with a single warp beam.

According to the invention, this object is achieved by a system comprising, in known manner:

first and second electric motors each for rotating one of the warp beams, first and second sensor means for providing electrical signals indicative of the tension of the warp threads unwound from the first and second beams respectively, and first and second electronic regulation devices associated with the first and second motors respectively and connected to the sensor means for regulating the rates of rotation of the motors so as to keep the tension of the warp substantially uniform, the system being characterised in that it also includes:

switching means interposed between the sensor means and the electronic regulation devices and adapted to switch at a predetermined frequency, higher than the beating frequency of the loom, between a first condition in which they connect the first and second sensor means to the first and second regulation devices respectively, and a second condition in which they connect the first and second sensor means to the second and first regulation devices respectively.

In the system according to the invention, the regulation devices associated with the motors of the two beams are piloted on the basis of information coming alternately from one warp-tension sensor and from the other. The motors associated with the beams are thus piloted substantially in dependence on a kind of average of the signals provided by the warp-tension sensors. This cancels out instability phenomena which could lead, for example, to the warp from one beam being slowed too much which in turn could cause the weft threads to deviate from their ideal position lines which, as is known, are perpendicular to the warp threads.

BRIEF DESCRIPTION OF THE DRAWINGS

Further characteristics and advantages of the invention will become clear from the detailed description which follows with reference to the appended drawings, provided purely by way of non-limiting example, in which.

DETAILED DESCRIPTION OF THE INVENTION

Figure 1:
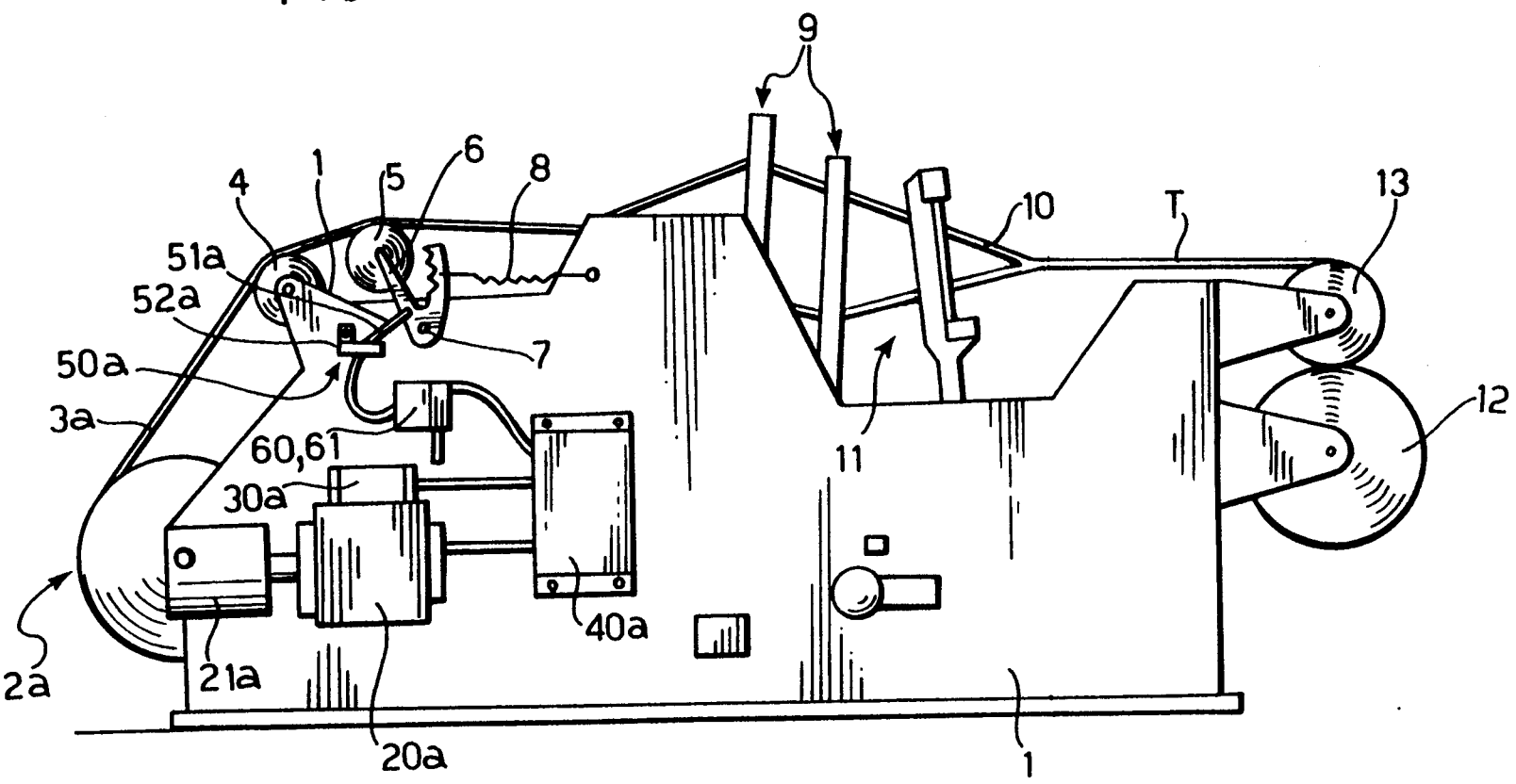
FIGS. 1 and 2 show schematically a side view and a rear view respectively of a loom with a system according to the invention for controlling the unwinding of the warp.
Figure 2:
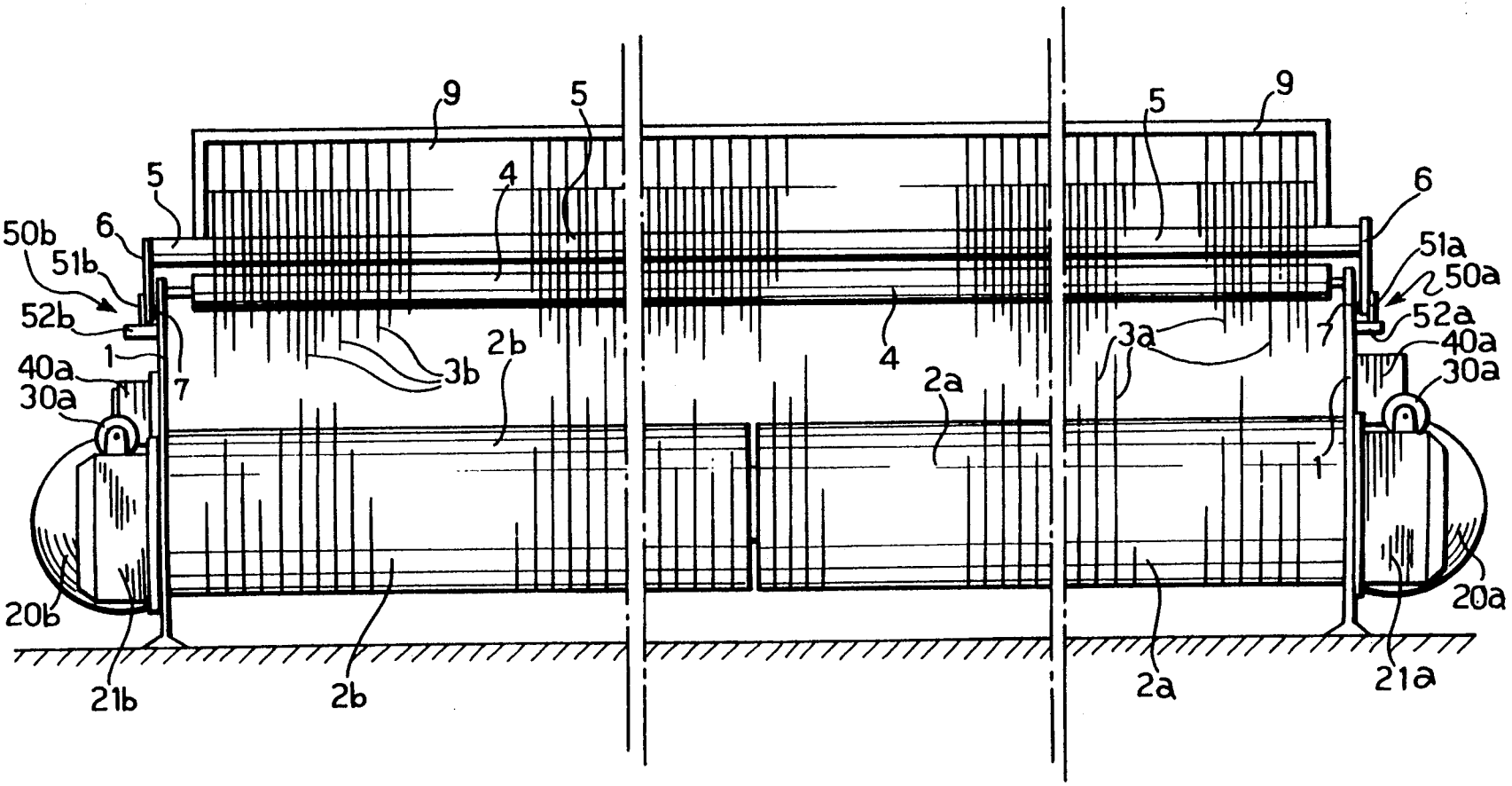

FIGS. 1 and 2 of the appended drawings show schematically a loom including a support framework 1 one end of which carries two warp beams 2*a* and 2*b* on which are wound the warp threads 3*a* and 3*b* which together form the warp to be interwoven with the weft threads in the loom.

The two beams 2*a* and 2*b* are arranged coaxially end to end and can be rotated independently.

The warp threads 3*a*, 3*b* pass over a single back rest 4 supported in a fixed position by the framework 1.

A further movable tensioning roller (the thread-carrier), indicated 5, is supported by rocker arms 6 pivoted at 7.

Upon leaving the beams 2*a* and 2*b*, the warp threads 3*a* and 3*b* are deflected around the thread-carrier 4 and are then tensioned by the thread-carrier 5 as a result of the action of resilient means 8 which urge the back rest upwards (FIG. 1).

The warp threads then reach a series of healds 9 which separate them into two rows defining the warp opening or shed 10 through which the weft threads are inserted in successive operations by known devices.

The batten, which—after the weft has been inserted—beats up the weft to form the fabric T, usually with a rotary motion, is indicated 11.

The piece of fabric is then wound onto a beam 12 by a breast beam 13.

Two electric motors 20*a* and 20*b* are fixed on the sides of the framework 1 near the beams 2*a* and 2*b* and their output shafts rotate the beams by means of respective geared transmission systems 21*a* and 21*b* associated therewith.

The transmissions 21*a* and 21*b* conveniently bring about a reduction in speed so that when the electric motors 20*a* and 20*b* are activated and their output shafts rotate at a certain speed, they rotate the respective beams at a much slower speed.

Tachometric sensors (dynamos) 30*a* and 30*b* are associated with the motors 20*a* and 20*b* for emitting respective pulsed electrical signals, the frequencies of which are indicative of the rates of rotation of the motors and hence of the speeds at which the warp threads are unwound from the beams 2*a* and 2*b*.

The tachometric sensors, which could also be constituted by so-called phonic-wheel sensors, could alternatively be connected to members of the transmissions 20*a* and 20*b* or to the shafts of the beams 2*a* and 2*b*.

The tachometric sensors 30*a* and 30*b* are connected to electronic regulators 40*a* and 40*b* for regulating the rates of rotation of the electric motors 20*a* and 20*b*.

Two devices, indicated 50*a* and 50*b*, for detecting the tensions of the warp threads are associated with the two ends of the thread-carrier 5. The sensors may be of any known type, for example, one of the types described in Italian patent 1,043,375.

In the embodiment shown schematically (see in particular FIG. 1), each sensor includes a strip 51*a*, 51*b* fixed to one arm of the rocker 6 which supports the thread-carrier. Each strip can extend between a light-emitter and a light-detector generally indicated 52*a* and 52*b* for a distance which is variable according to the position of the thread-carrier 5. Variations in the tensions of the warp threads change the position of the thread-carrier and consequently the extent to which the strips 51*a* and 51*b* intercept the radiation between the light-emitters and the light-detectors associated therewith.

Figure 3:
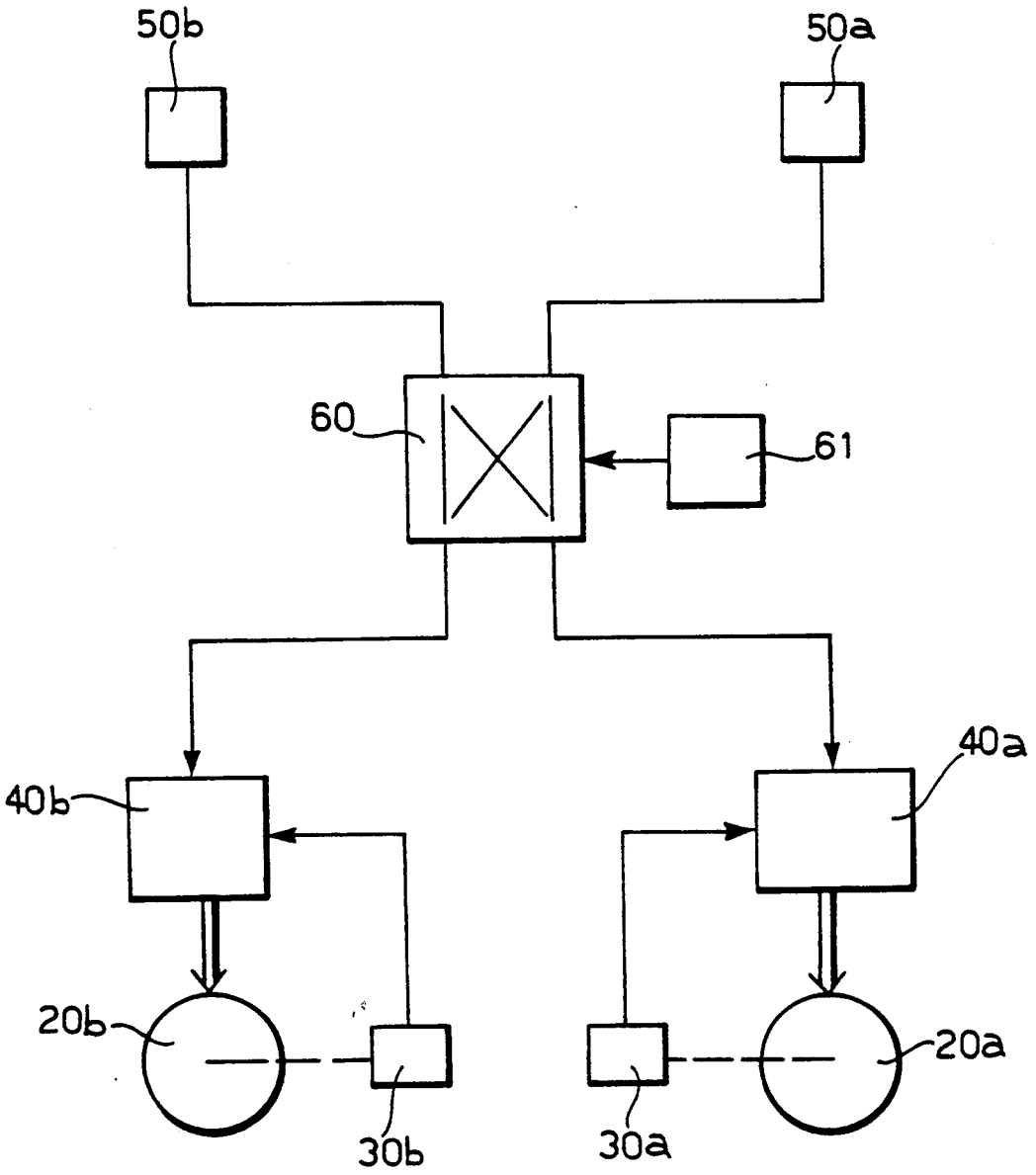
FIG. 3 is a circuit block diagram of the system for controlling the unwinding of the warp according to the invention.

As shown in FIG. 3, the sensors 50*a* and 50*b* for detecting the tensions of the warp threads are connected to a switching device 60. This device can assume a first condition in which it connects the sensor 50*a* to the speed regulator 40*a* and the sensor 50*b* to the regulator 40*b*, and a second condition in which the connections between the warp tension sensors and the speed regulators are changed over. In this second condition, the switching device 60 thus connects the sensor 50*a* to the regulator 40*b* associated with the beam 2*b* and the sensor 50*b* to the regulator 40*a* associated with the beam 2*a*.

In FIG. 3, a device for piloting the switching of the switch 60 at a predetermined frequency higher than the frequency at which the weft threads are beaten up, for example a frequency of between 20 Hz and 80 Hz and preferably about 50 Hz, is indicated 61.

The device 61 may be formed, for example with the use of an oscillator or, more simply, by a circuit for processing the waveform of the alternating mains voltage.

Thus, the switch can be arranged to switch between the first and second conditions at a frequency which is a harmonic or subharmonic of the main voltage frequency.

In operation, the regulators 40*a* and 40*b* control the rates of rotation of the associated beams 2*a* and 2*b* in dependence on the signals which reach them at a high frequency, through the switching device 60, from the tension-sensors 50*a* and 50*b* alternately.

Tests carried out by the Applicant have shown that the system according to the invention ensures the perfect unwinding of the warp from twin warp beams without any problems such as deviations in the positions of the weft threads which might cause tightening or sagging of the fabric.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A system for controlling the unwinding of the wrap in a loom in which the warp is wound onto at least two beams arranged end to end and rotatable independently of each other, the system including:

first and second electric motors each for rotating one of the warp beams, first and second sensor means for providing electrical signals indicative of the tensions of the warp threads unwound from the first and second beams respectively, first and second electronic regulation devices associated with the first and second motors respectively and connected to the sensor means for regulating the rates of rotation of the motors so as to keep the tension of the warp substantially uniform, and switching means interposed between the sensor means and the electronic regulation devices and adapted to switch at a predetermined frequency, higher than the beating frequency of the loom, between a first condition in which they connect the first and second sensor means to the first and second regulation devices respectively, and a second condition in which they connect the first and second sensor means to the second and first regulation devices respectively.

2. A system according to claim 1, wherein the switching means are arranged to switch between the first and second conditions at a frequency which is a harmonic or a subharmonic of the mains voltage frequency.

* * * * *